United States Patent [19]

Sundermeyer

[11] Patent Number: 4,938,142

[45] Date of Patent: Jul. 3, 1990

[54] DROPPABLE AMMUNITION

[75] Inventor: Peter Sundermeyer, Lauf, Fed. Rep. of Germany

[73] Assignee: DIEHL GmbH & Co., Nuremberg, Fed. Rep. of Germany

[21] Appl. No.: 370,197

[22] Filed: Jun. 22, 1989

[30] Foreign Application Priority Data

Jul. 19, 1988 [DE] Fed. Rep. of Germany ..... 3824374

[51] Int. Cl.[5] ..... F42B 23/24

[52] U.S. Cl. ..... 102/293; 89/1.14; 102/401

[58] Field of Search ..... 102/293, 387, 401; 89/1.11, 1.14; 244/142, 151 B

[56] References Cited

U.S. PATENT DOCUMENTS

| | | | |
|---|---|---|---|
| 2,616,748 | 11/1952 | Hight | 89/1.14 |
| 2,732,153 | 1/1956 | Frieder et al. | 89/1.14 |
| 2,768,802 | 10/1956 | DeJean | 89/1.14 |

*Primary Examiner*—Charles T. Jordan

*Attorney, Agent, or Firm*—Scully, Scott, Murphy & Presser

[57] ABSTRACT

Droppable or air-delivered ammunition, especially ammunition which is adapted to lie in-wait or in a lurking condition, and which includes a parachute and with a device for clearing away the parachute subsequent to being deposited on the ground.

4 Claims, 1 Drawing Sheet

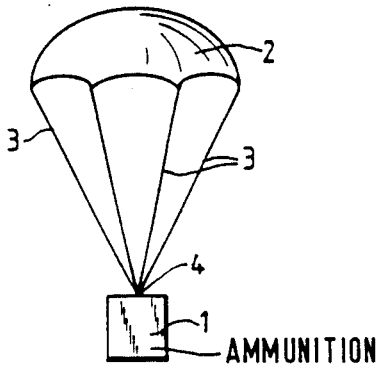
2
3
3
4
1
AMMUNITION
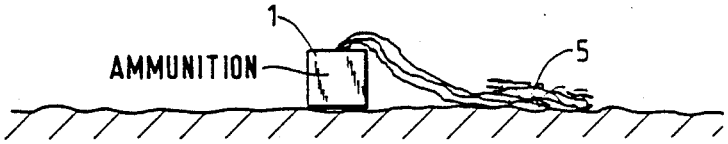
1
AMMUNITION
5

DROPPABLE AMMUNITION

BACKGROUND OF THE INVENTION

1. Field of the Invention

The present invention relates to droppable or air-delivered ammunition, especially ammunition which is adapted to lie in-wait or in a lurking condition, and which includes a parachute and with a device for clearing away the parachute subsequent to being deposited on the ground.

2. Discussion of the Prior Art

A droppable article of ammunition of that type has already become known from the disclosure of German Patent 28 34 435. In that publication there is provided a description of a separating device for the automatic separation of a parachute from a load upon striking against the ground. The separating device opens itself at impact with the ground. The parachute is then able to distance itself from the droppable ammunition. However, as a rule, the parachute will remain in proximity to the droppable ammunition and thereby cause the position thereof to become recognizable, so that it becomes possible to evade the landed ammunition, or to enable the attacking of the latter. This is particularly undesirable for ammunition which lies in-wait, inasmuch as this ammunition comes into action only after a longer period of time.

SUMMARY OF THE INVENTION

Accordingly, it is an object of the present invention that, for an article of droppable or air-delivered ammunition of the type which is described therein, to be able to render the parachute unrecognizable on the ground.

Pursuant to the invention, the foregoing object is attained in that fuse cords or ignition tapes are integrated into the parachute, and provision is made for a fuze which ignites the fuse cords subsequent to the landing on the ground.

As a result of the foregoing, when the droppable ammunition has struck against the ground, this will then cause the fabric of the parachute to be either charred or melted down by the fuse cords. Consequently, the parachute is barely or not at all recognizable on the ground. In particular, the parachute is no longer able to billow out in response to the action of wind.

BRIEF DESCRIPTION OF THE DRAWING

Advantageous embodiments of the invention can now be readily ascertained from the following detailed description taken on the basis of an exemplary embodiment thereof, and in which the single figure of drawing illustrates an article of droppable or air-delivered ammunition during descending or sinking flight and also an article which has landed on the ground.

DETAILED DESCRIPTION

An article of droppable or air-delivered ammunition 1 is equipped with a parachute 2 which is fastened to the former through shroud lines 3. The parachute 2 is constituted from a fabric of plastic fibers which are easily meltable. Some or all of the shroud lines 3 are encompassed with pyrotechnic fuse cords. The fuse cords also extend along the region of the fabric for the parachute 2.

A pyrotechnic fuze 4 is arranged in the region of the fastening or attaching locations of the shroud lines 3 to the droppable ammunition 1.

For example, the fuze 4 responds upon the contact of the droppable ammunition 1 with ground. Thereupon, the fuze ignites the fuse cords. These fuse cords generate thermal energy during the combustion sequence, so as to cause the fabric of the parachute 2 to melt. The parachute 2 is thereby reduced to configuration 5 which is extremely difficult to recognize and which is hardly identifiable, and which comes hardly in view in the terrain near the droppable ammunition 1. In view of the foregoing, there is achieved the aspect that the droppable ammunition 1 will not be betrayed by the presence of the parachute 2 subsequent to its landing on the ground.

What is claimed is:

1. A droppable ammunition, in particular ammunition which is adapted to lie in-wait; comprising a parachute and means for the elimination of said parachute subsequent to landing of said ammunition on the ground; the parachute being equipped with fuse cords and with a fuze which ignites the fuse cords subsequent to said landing on the ground.

2. A droppable ammunition as claimed in claim 1, wherein the fuse cords are combined with shroud lines of said parachute.

3. A droppable ammunition as claimed in claim 1, wherein the fuse cords extend through the fabric of said parachute.

4. Droppable ammunition as claimed in claim 1, wherein the fuse cords are arranged on the parachute so as to melt the fabric of said parachute during the combusting of the fuse cords.

* * * * *